US008325968B2

(12) United States Patent
Pan et al.

(10) Patent No.: US 8,325,968 B2
(45) Date of Patent: Dec. 4, 2012

(54) SPEAKER

(75) Inventors: Zheng-Min Pan, Shenzhen (CN); Bing-Ke Zhu, Shenzhen (CN)

(73) Assignees: AAC Acoustic Technologies (Shenzhen) Co., Ltd., Shenzhen (CN); American Audio Components Inc., La Verne, CA (US)

( * ) Notice: Subject to any disclaimer, the term of this patent is extended or adjusted under 35 U.S.C. 154(b) by 234 days.

(21) Appl. No.: 12/858,167

(22) Filed: Aug. 17, 2010

(65) Prior Publication Data

US 2011/0150265 A1 Jun. 23, 2011

(30) Foreign Application Priority Data

Dec. 21, 2009 (CN) ..... 2009 2 0261781 U

(51) Int. Cl.
*H04R 11/02* (2006.01)

(52) U.S. Cl. ..... 381/407; 381/335; 381/398

(58) Field of Classification Search ..... 381/335, 381/398, 431, 407, 337, 339
See application file for complete search history.

(56) References Cited

U.S. PATENT DOCUMENTS 6,031,925 A * 2/2000 Shteyn ..... 381/401

* cited by examiner

*Primary Examiner* — Curtis Kuntz
*Assistant Examiner* — Amir Etesam
(74) *Attorney, Agent, or Firm* — IPro, Inc.; Na Xu

(57) ABSTRACT

A speaker includes a magnetic circuit defining a magnetic gap, a diaphragm defining a central part and peripheral part surrounded the central part of the diaphragm, a coil defining an end suspended in the magnetic gap, an elastic plate defining a central flat coupled to the central part of the diaphragm and a side coupled to another end of the coil. And the side of the elastic plate comprises a first part extending perpendicularly from the central flat toward the peripheral part of the diaphragm and a second part extending parallel to the central flat for coupling another end of the coil.

4 Claims, 1 Drawing Sheet

SPEAKER

FIELD OF THE INVENTION

The present invention generally relates to the art of speakers.

RELATED ART OF THE INVENTION

Speakers are widely used in portable devices, such as mobile phones, notebook computers, or portable media players, to convert electrical signals to sound waves.

FIG. 1 illustrates a speaker 1 related to the present invention. The speaker 1 comprises a magnetic circuit 11, a diaphragm 14, and a coil 13 coupled to the diaphragm 14. The magnetic circuit 11 defines a magnetic gap 111 for providing magnetic field therein. The diaphragm 14 includes a central part 15 and a peripheral part 17 surrounding and coupled to the central part 15. The coil 13 defines one end suspended in the magnetic gap 111 and another end coupled to a joint portion of the central part 15 and a peripheral part 17. Thus, a diameter of the coil 13 is substantially equal to a diameter of the central part 15 of the diaphragm 14. When electrified, the coil 13 can drive the diaphragm 14 to move synchronously by virtue of the electro-magnetic force. The coil is directly coupled to the diaphragm 14 and the length of the coil is required to be long enough to generate sufficient vibration. However, length of the coil will cause the entire height of the speaker to be greater.

SUMMARY OF THE INVENTION

In one exemplary embodiment of the present invention, a speaker comprises a magnetic circuit defining a magnetic gap, a diaphragm defining a central part and peripheral part surrounded the central part of the diaphragm, a coil defining an end suspended in the magnetic gap, an elastic plate defining a central flat coupled to the central part of the diaphragm and a side coupled to another end of the coil. And the side of the elastic plate comprises a first part extending perpendicularly from the central flat toward the peripheral part of the diaphragm and a second part extending parallel to the central flat for coupling another end of the coil.

Other features and advantages of the present invention will become more apparent to those skilled in the art upon examination of the following drawings and detailed description of the exemplary embodiment.

DETAILED DESCRIPTION OF EXEMPLARY EMBODIMENTS

Reference will now be made to describe a number of embodiments of the present invention in detail.

Figure 1:
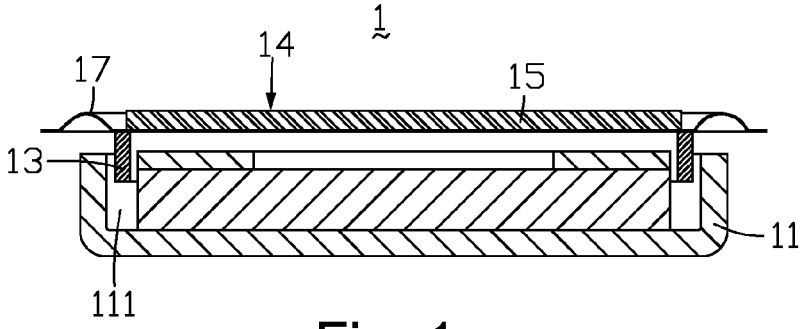
Fig. 1 ( Prior Art )
FIG. 1 illustrates a cross-sectional view of a speaker related to the present invention.
Figure 2:
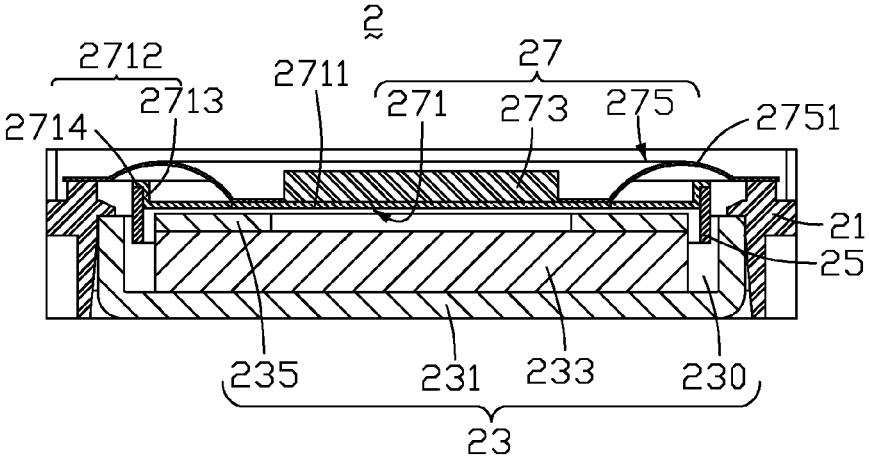
FIG. 2 illustrates a cross-sectional view of a speaker in accordance with a first embodiment of the present invention.

Referring to FIG. 2, a speaker 2, in accordance with a first embodiment of the present invention, includes a case 21 having a receiving space, a magnetic circuit 23 assembled with the case 21, a coil 25 and a vibrating system 27.

The magnetic circuit 23 comprises a yoke 231 assembled with the case 21, a magnet 233 fixed on a surface of the yoke 231 with a plate 235 attached thereon, and a magnetic gap 230 for accommodating the coil 25.

The vibrating system 27 comprises an elastic plate 271, and a diaphragm 275 couple to the elastic plate 271.

The diaphragm 275 comprises a central part 273 and a peripheral part 2751 surrounding the central part 273.

The elastic plate 271 includes a central flat 2711 and a side 2712 surrounding and coupled to the central flat 2711. At least a part of the central flat 2711 is coupled to the central part 273 of the diaphragm 275, and the side 2712 of the elastic plate 271 is below the peripheral part 2751 of the diaphragm 275.

The side 2712 includes a first part 2713 extending perpendicularly from the central flat 2711 toward the peripheral part 2751 of the diaphragm 275, and a second part 2714 extending parallel to the central flat 2711. In another word, the second part is perpendicular to the first part.

The coil 25 is a ring and defines one end suspended in the magnetic gap 230 and another end connected to the second part 2714 of the side 2712. Furthermore, an inner side of the coil 25 contacts an outer surface of the first part 2713 of the side 2712 of the elastic plate. So, an inner diameter of the coil 25 is equal to an outer diameter of the central flat 2711 of the elastic plate 271, and at the same time, is greater than a diameter of the central part 273 of the diaphragm 275. As a result, the diameter of the coil is enlarged and the length of the coil is lengthened without increasing the height of the speaker. Another word, the present invention can reduce the height of the speaker while using a coil having a certain length.

Figure 3:
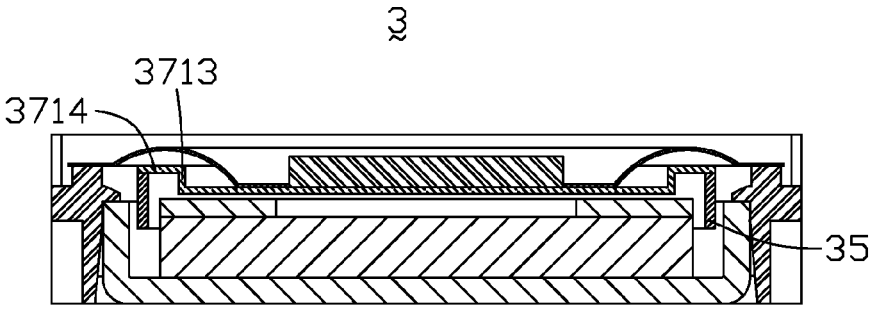
FIG. 3 illustrates a cross-sectional view of a speaker in accordance with a second embodiment of the present invention.

Referring to FIG. 3, a speaker 3, in accordance with a second embodiment of the present invention, is shown. What is different from the first embodiment is that, a gap is formed between the coil 35 and the first part 3713. So, a diameter of the coil is further increased.

When the coil is electrified, the coil is forced to move and drive the elastic plate, together with the diaphragm to vibrate for producing sound waves.

While the present invention has been described with reference to specific embodiments, the description of the invention is illustrative and is not to be construed as limiting the invention. Various of modifications to the present invention can be made to the exemplary embodiments by those skilled in the art without departing from the true spirit and scope of the invention as defined by the appended claims.

What is claimed is:

1. A speaker, comprising:

a magnetic circuit defining a magnetic gap; a diaphragm defining a central part and peripheral part surrounded the central part of the diaphragm; a coil defining an end suspended in the magnetic gap; an elastic plate; wherein, the elastic plate comprises a central flat coupled to the central part of the diaphragm and a side coupled to another end of the coil, and the side of the elastic plate comprises a first part extending perpendicularly from the central flat toward the peripheral part of the diaphragm and a second part extending parallel to the central flat for coupling another end of the coil; and wherein another end of the coil coupled to the side of the elastic plate is higher than the central flat of the elastic plate.

2. The speaker as described in claim 1, wherein an inner diameter of the coil is equal to an outer diameter of the central flat of the elastic plate.

3. The speaker as described in claim 1, wherein an inner diameter of the coil is greater than an outer diameter of the central flat of the elastic plate.

4. The speaker as described in claim 1, wherein a gap is formed between the coil and the first part of the side of the elastic plate.

* * * * *